US006213744B1

(12) United States Patent
Choroszylow et al.

(10) Patent No.: US 6,213,744 B1
(45) Date of Patent: Apr. 10, 2001

(54) PHASED ROTARY DISPLACEMENT DEVICE

(76) Inventors: Ewan Choroszylow, 125 Church St., East Aurora, NY (US) 14052; Giovanni Aquino, 29 Byron Ave., Kenmore, NY (US) 14223; Howard J. Greenwald, 111 Hickory Ridge Rd., Rochester, NY (US) 14625

( * ) Notice: Subject to any disclaimer, the term of this patent is extended or adjusted under 35 U.S.C. 154(b) by 0 days.

(21) Appl. No.: 09/441,312

(22) Filed: Nov. 16, 1999

(51) Int. Cl.[7] ..... F03C 2/00
(52) U.S. Cl. ..... 418/61.2; 418/179
(58) Field of Search ..... 418/61.2, 179

(56) References Cited

U.S. PATENT DOCUMENTS

| | | | | |
|---|---|---|---|---|
| 3,173,406 | * | 3/1965 | Campos | 418/612 |
| 3,226,013 | * | 12/1965 | Toyoda et al. | 418/61.2 |
| 3,242,912 | * | 3/1966 | Huber | 418/61.2 |
| 3,400,604 | * | 9/1968 | Jones | 418/61.2 |
| 3,465,729 | * | 9/1969 | Jones | 418/61.2 |
| 3,764,239 | * | 10/1973 | Huf | 418/61.2 |
| 3,799,706 | * | 3/1974 | Bilobran | 418/61.2 |
| 5,431,551 | * | 7/1995 | Aquino et al. | 418/61.2 |
| 5,769,619 | * | 6/1998 | Crvelin et al. | 418/61.2 |
| 5,947,709 | * | 9/1999 | Koyama et al. | 418/55.3 |

FOREIGN PATENT DOCUMENTS

| | | | | |
|---|---|---|---|---|
| 1137899 | * | 10/1962 | (DE) | 418/61.2 |
| 1273898 | * | 7/1968 | (DE) | 418/61.2 |
| 2433134 | * | 1/1975 | (DE) | 418/61.2 |
| 3541820 | * | 6/1987 | (DE) | 418/61.2 |
| 2077357 | * | 12/1981 | (GB) | 418/61.2 |

* cited by examiner

*Primary Examiner*—Thomas Denion
*Assistant Examiner*—Theresa Trieu
(74) *Attorney, Agent, or Firm*—Greenwald & Basch LLP; Howard J. Greenwald

(57) ABSTRACT

A rotary device containing a housing with two side plates, a shaft, an eccentric connected to the shaft, a rotor mounted on the shaft, a first gear, and a second gear. The rotor contains at least 3 sides, the housing has an interior surface defined by at least a first lobe and a second lobe, the first gear is an internal gear which is connected to the rotor, the second gear is an external gear connected to the housing, the difference between the pitch diameter of the first gear and the pitch diameter of the second gear is is equal to twice said eccentricity of the eccentric, and the ratio between the pitch diameter of the first gear and the pitch diameter of the second gear is equal to the ratio between the number of said sides in said rotor divided by the number of lobes in the interior surface of said housing.

12 Claims, 6 Drawing Sheets

PHASED ROTARY DISPLACEMENT DEVICE

FIELD OF THE INVENTION

A phased trochoidal rotary chamber device which can be used for compression and expansion of fluid, pumping of liquid, or as a hydraulic motor.

BACKGROUND OF THE INVENTION

In U.S. Pat. No. 5,769,619, applicants described and claimed a rotary device comprised of a housing comprising a curved inner surface in the shape of a trochoid and an interior wall, an eccentric mounted on a shaft disposed within said housing, a first rotor mounted on said eccentric shaft which is comprised of a first side and a second side, a first pin attached to said rotor and extending from said rotor to said interior wall of said housing, and a second pin attached to said rotor and extending from said rotor to said interior wall of such housing, and a third pin attached to said rotor and extending from said rotor to said interior wall of said housing. This rotary device also contains the following features: (1) a continuously arcuate track is disposed within said interior wall of said housing, wherein said continuously arcuate track is in the shape of an envoluted trochoid, (2) said first pin has a distal end which is disposed within said continuously arcuate track, (3) said second pin has a distal end which is disposed within said continuously arcuate track, (4) said third pin has a distal end which is disposed within said continuously arcuate track, (5) said distal end of said first pin is comprised of a shaft disposed within a first rotatable sleeve, (6) said distal end of said second pin is comprised of a shaft disposed within a second rotatable sleeve, said distal end of said third sleeve is comprised of a shaft disposed within a third rotatable sleeve, (7) said rotor is comprised of a multiplicity of apices, wherein each such apex forms a compliant seal with said curved inner surface, and wherein each such apex is comprised of a separate curved surface which is formed from a strip of material pressed into a recess, (8) said curved inner surface of said housing is generated from an ideal epictrochoidal curve and is outwardly recessed from said ideal epitrochoidal curve by a distance of from about 0.05 to about 5 times as great as the eccentricity of said eccentric, (9) the diameter of the distal end of each of said first pin and said second pin is from about 2 to about 4 times as great as said eccentricity of said eccentric, and (10) each of said first pin, said second pin, and said third pin extends from beyond said interior wall of said housing by from about 1 to about 2 times the diameter of each of said pins. The entire disclosure of this U.S. Pat. No. 5,769,619 is hereby incorporated by reference into this specification.

It is an object of this invention to provide a trochoidal rotary chamber device which is more durable, more reliable, and more efficient than the trochoidal rotary chamber device described and claimed in U.S. Pat. No. 5,769,619.

SUMMARY OF THE INVENTION

In accordance with this invention, there is provided a rotary device comprised of a housing with a side plate, a shaft disposed within said housing, a rotor mounted on said shaft, and a set of meshing gears, one with internal teeth attached to the rotor, and the other with external teeth attached to the side plate of the housing, both of such gears being concentric to the element they are attached to.

BRIEF DESCRIPTION OF THE DRAWINGS

The invention will be described by reference to the specification and the enclosed drawings, in which like elements are identified by like numerals, and in which.

DESCRIPTION OF THE PREFERRED EMBODIMENTS

The instant invention is comprised of an improvement on the structure disclosed in U.S. Pat. No. 5,769,619.

Figure 1:
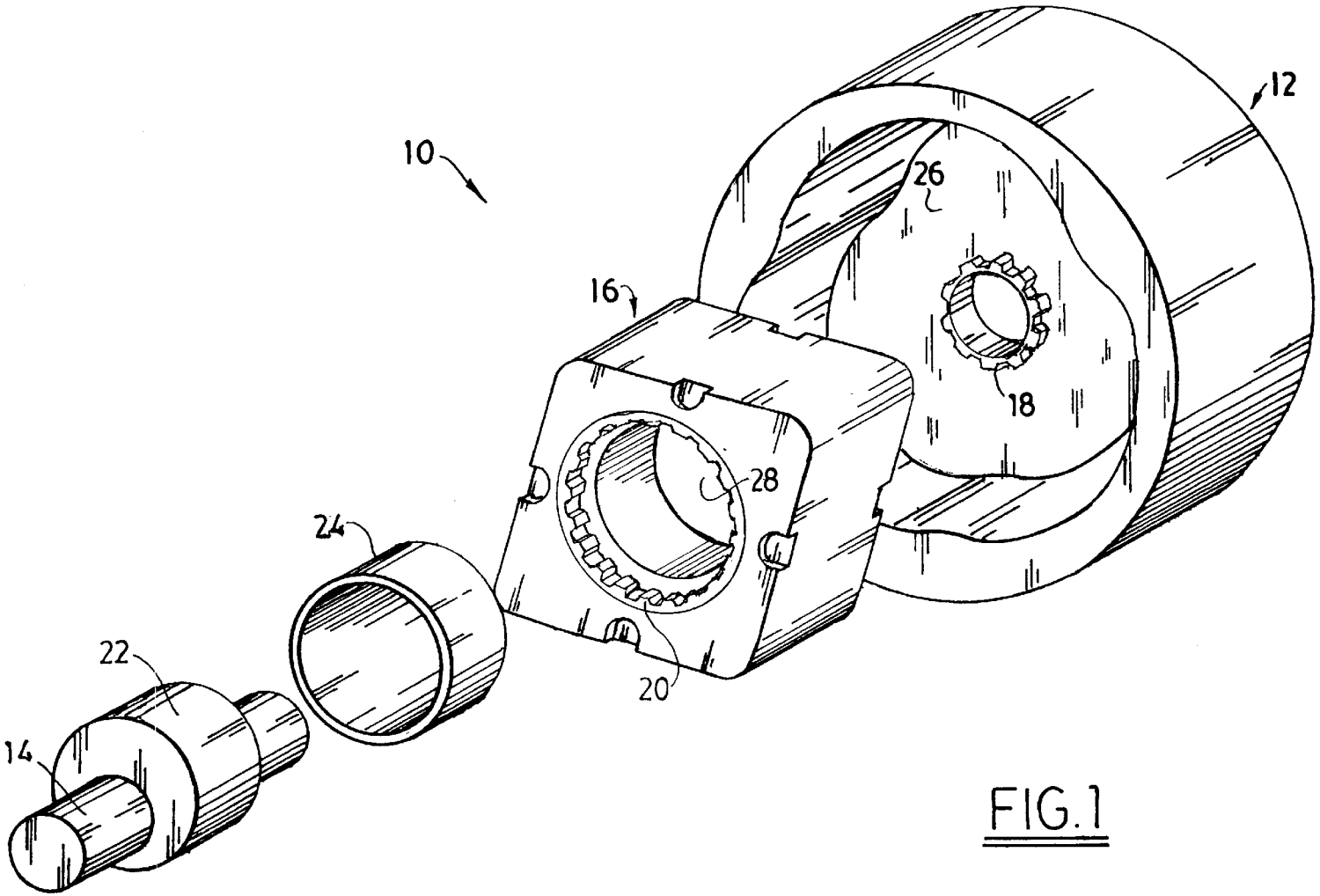
FIG. 1 is an exploded view of one preferred rotary mechanism of the invention.

FIG. 1 is an exploded perspective view of one preferred rotary mechanism 10. Referring to FIG. 1, it will be seen that rotary mechanism 10 is comprised of housing 12, shaft 14, rotor 16, external gear 18, internal gear 20, eccentric 22, bearing 24, and side plate 26.

Referring again to FIG. 1, it will be seen that housing 12 is preferably an integral structure. However, housing 12 may comprise two or more segments joined together by conventional means such as, e.g., bolts.

In one embodiment, housing 12 consists essentially of steel. As is known to those skilled in the art, steel is an alloy of iron and from about 0.02 to about 1.5 weight percent of carbon; it is made from molten pig iron by oxidizing out the excess carbon and other impurities (see, e.g., pages 23–14 to 23–56 of Robert H. Perry et al.'s "Chemical Engineer's Handbook," Fifth Edition (McGraw-Hill Book Company, New York, New York, 1973).

In another embodiment, housing 12 consists essentially of aluminum. In yet another embodiment, housing 12 consists essentially of plastic. These and other suitable materials are described in George S. Brady et al.'s "Materials Handbook," Thirteenth Edition (McGraw-Hill, Inc., New York, New York, 1991).

In another embodiment, housing 12 consists essentially of ceramic material such as, e.g., silicon carbide, silicon nitride, etc.

In one embodiment, housing 12 is coated with a wear-resistant coating such as, e.g., a coating of alumina formed electrolytically, electroless nickel, tungsten carbide, etc.

One advantage of applicant's rotary mechanism 10 is that the housing need not be constructed of expensive alloys which are resistant to wear; and the inner surface of the housing need not be treated with one or more special coatings to minimize such wear. Thus, applicants' device is substantially less expensive to produce than prior art devices.

Housing 12 may be produced from steel stock (such as, e.g., C1040 steel stock) by conventional milling techniques. Thus, by way of illustration, one may use a computer numerical controlled milling machine which is adapted to cut a housing 12 with the desired curved surface.

Similarly, the rotor 16 may be made of any material(s) from which the housing 12 is made.

Referring again to FIG. 1, and in the preferred embodiment depicted therein it will be seen that housing 12 is comprised of an external gear 18 mounted on an inner wall 26 of such housing 12. The external gear 18 is so disposed that, when drive shaft 14 is disposed therein, the gear 18 is concentric to the drive shaft 14.

The external gear 18 preferably has a substantially circular cross-sectional shape.

In order for the external gear 18 and the internal gear 20 to phase properly the rotor 16 in the housing 12, they have to meet two different conditions. In the first place, the difference between the two pitch diameters of the internal and external gears must be exactly twice the eccentricity of the shaft 22. In the second place, the ratio between the pitch diameters of the internal and external gears must be the same as the ratio between the numbers of sides in rotor 16 divided by the number of lobes in housing 12. These criteria will be discussed in more detail later in this specification.

The eccentricity of eccentric 22 generally will be from about 0.05 to about 10 inches. It is preferred that the eccentricity be from about 0.15 to about 1.5 inches.

Referring again to FIG. 1, and in the preferred embodiment depicted therein, it will be seen that bearing 24 can either be a sleeve bearing and/or a rolling element bearing.

Figure 2:
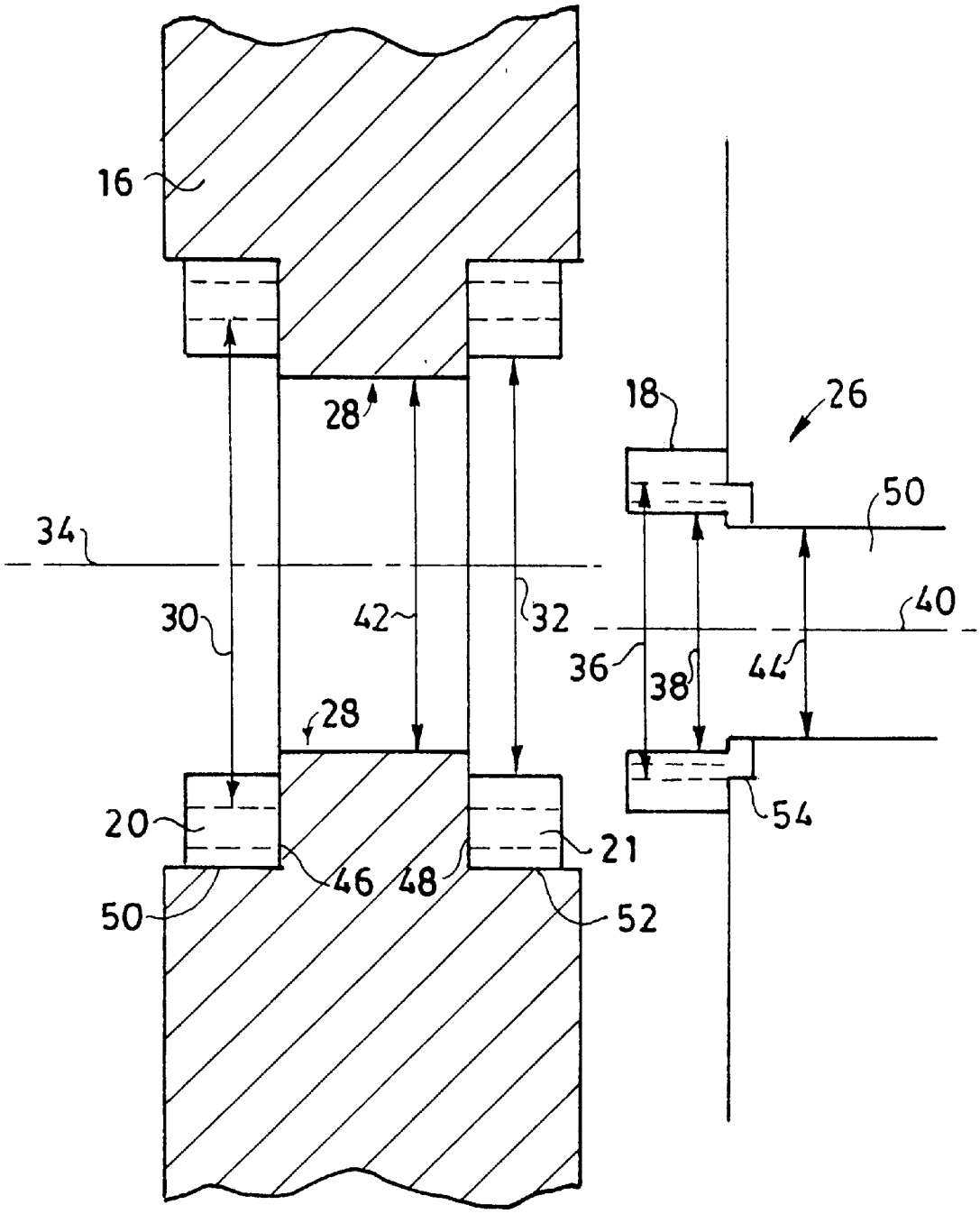
FIG. 2 is partial sectional view of the mechanism of FIG. 1, illustrating the interaction between the rotor and external gear on the side plate of the housing.

Referring to FIG. 2, it will be seen that rotor 16 is comprised of a bore 28 with a center line 34 and an internal diameter 42. The internal diameter 42 of bore 28 is smaller than the pitch diameter 30 of internal gear 20.

As is known to those skilled in the art, the term pitch diameter refers to the diameter of an imaginary circle, which commonly is referred to as the "pitch circle," concentric with the gear axis 34, which rolls without slippage with a pitch circle of a mating gear. Reference may be had, e.g., to U.S. Pat. Nos. 5,816,788, 5,813,488, 5,704,865, 5,685,269, 5,474,503, 5,454,175, 5,387,000, and the like. The disclosure of each of these U.S. patents is hereby incorporated by reference into this specification.

Referring again to FIG. 2, it will be seen internal diameter 42 is also smaller than diameter 32 of the addendum circle of internal gear 20. As is known to those skilled in the art, the addendum circle is a circle on a gear passing through the tops of the gear teeth. See, e.g., U.S. Pat. Nos. 5,438,732, 5,154,475, 5,090,771, 4,864,893, 4,813,853, 4,780,070, and the like. The entire disclosure of each of these U.S. patents is hereby incorporated by reference into this specification.

Referring again to FIG. 2, it will be seen that two internal gears 20 and 21 are depicted, one of which is disposed at end 46 of the rotor 16, and the other which is disposed at end 48 of rotor 16. In the preferred embodiment depicted, each of gears 20 and 21 is disposed within a counterbore (50 and 52, respectively). In another embodiment, not shown, only one gear 20 or 21 is disposed on one side of rotor 16.

The gears 20,21 may be attached to rotor 16 by conventional means such as, e.g., by mechanical means (using fasteners such as bolts, internal retaining rings, etc.), by interference fit, by electron beam welding, etc.

In the embodiment depicted in FIG. 1, the rotor 16 contains four sides and has a substantially square shape. As will be apparent to those skilled in the art, one may use rotors with 3 sides (not shown), 5 sides, 6 sides, etc. In general, it is preferred the rotor contain at least 3 sides and no more 6 sides.

Referring again to FIG. 2, it will be seen that an external gear 18 is disposed within side plate 26 and, more precisely, within counterbore 54 of side plate 26. In the embodiment depicted, only one such external gear 18 is shown disposed on one side plate. In another embodiment, not shown, two such external gears are used and are disposed on both sides of rotor 16. It will be apparent that, although only one side plate 26 is shown in FIGS. 1 and 2 for the sake of simplicity of representation, at least two such side plates generally are required for each housing, one for each side of the housing.

Referring again to FIG. 2, it will be seen that side plate 26 is comprised of a bore 50 with a centerline 40 and an internal diameter 44. The internal diameter 44 of bore 50 is smaller than the pitch diameter 36 of external gear 18.

It will be seen that internal diameter 44 is also smaller than the diameter 38 of the external gear 18, which is the inner bore of external gear 18.

The gear(s) 18 may be attached to side plate 26 by conventional means such as, e.g., by mechanical means (using fasteners such as bolts, internal retaining rings, etc.), by interference fit, by electron beam welding, etc.

As mentioned elsewhere in this specification, in order for the external gear 18 and the internal gear 20 to phase properly the rotor 16 in the housing 12, two different conditions must be met. In the first place, the difference between the two pitch diameters of the internal and external gears (viz., pitch diameters 30, and 36) must be exactly twice the eccentricity of the shaft 22. In the second place, the ratio between the pitch diameters 30 and 36 of the internal and external gears must be the same as the ratio between the numbers of sides in rotor 16 divided by the number of lobes in housing 12.

Figure 3:
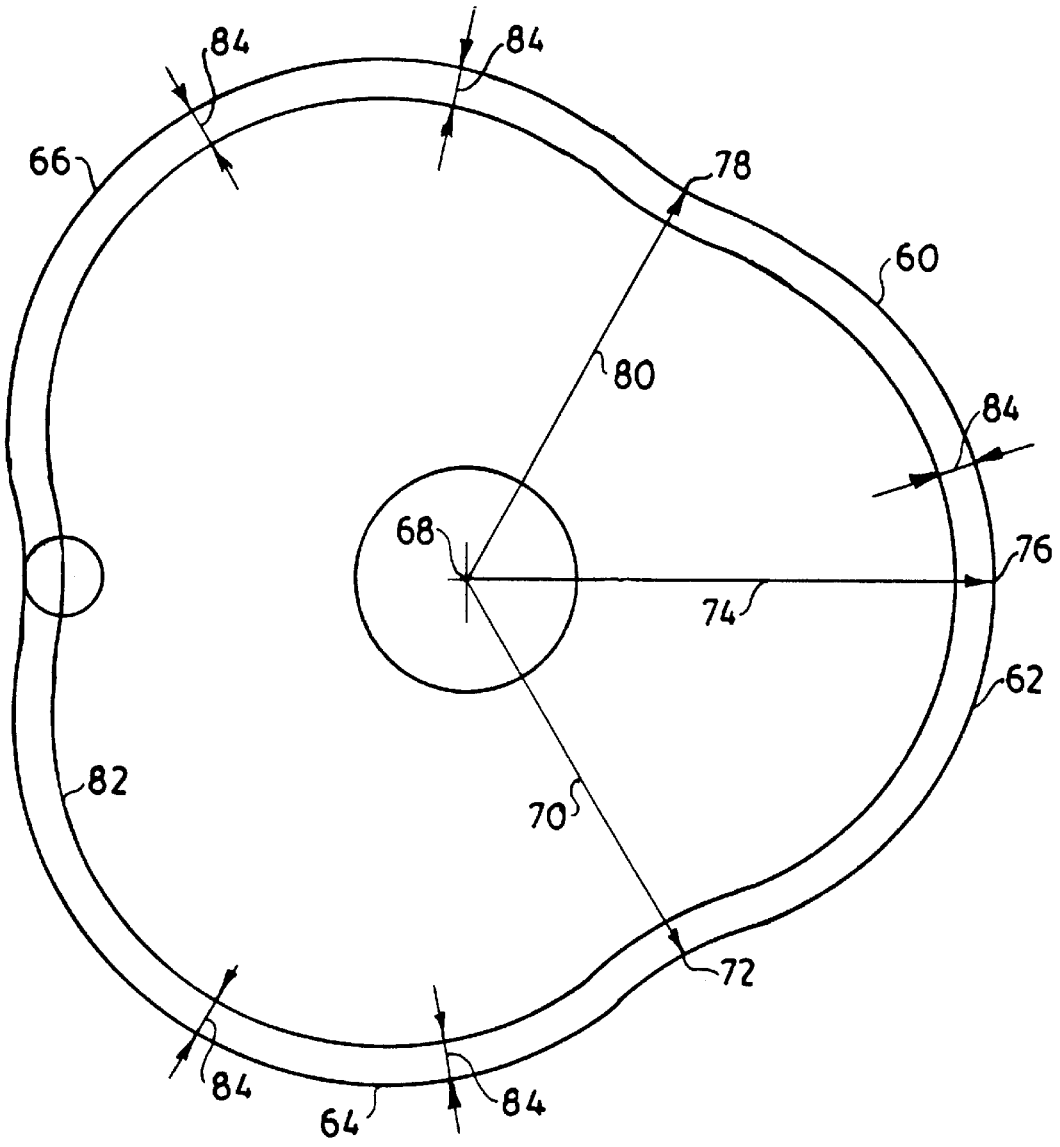
FIG. 3 is a schematic representation of a trochoidal surface and an envoluted trochoidal surface produced by the device of this invention.

FIG. 3 is a schematic representation of trochoidal surface 82 and envoluted trochoidal surface 60 referred to in this specification. Referring to FIG. 3, and in the preferred embodiment depicted therein, it will be seen that surface 60 defines a multiplicity of lobes 62, 64, and 66 which, in combination, define an inner surface 60 which has a continuously changing curvature.

Referring again to FIG. 3, it will be seen that, with regard to lobe 62, the distance from the centerpoint 68 to any one point on lobe 62 will preferably differ from the distance from the centerpoint to an adjacent point on lobe 62; both the curvature and the distance from the centerpoint 68 is preferably continuously varying in this lobe (and the other lobes). Thus, for example, the distance 70 between point 68 and 72 is preferably substantially less than the distance 74 between points 68 and 76; as one progresses from point 72 to point 76 around surface 60, such distance preferably continuously increases as the curvature of lobe 62 continuously changes. Thereafter, as one progresses from point 76 to point 78, the distance 80 between point 68 and point 78 preferably continuously decreases.

Referring again to FIG. 3, it will be apparent to those skilled in the art that, in this preferred embodiment, the same situation also applies with lobes 66 and 64. Each of such lobes is preferably defined by a continuously changing curved surface; and the distance from the centerpoint 68 is preferably continuously changing between adjacent points.

In the preferred embodiment illustrated in FIG. 3, it is preferred to have at least two of such lobes 62, 64, and 66. It is more preferred to have at least three of such lobes. In another embodiment, at least four of such lobes arc present.

It is preferred that each lobe present in the inner surface 60 have substantially the same curvature and shape as each of the other lobes present in inner surface 60. Thus, referring to FIG. 3, lobes 62, 64, and 66 are displaced equidistantly around centerpoint 68 and have substantially the same curvature as each other.

The curved surface 60 may be generated by conventional machining procedures. Thus, as is disclosed in U.S. Pat. No.

4,395,206, the designations "epitrochoid" and "hypotrochoid" surfaces refer to the manner in which a trochoid machine's profile curves are generated; see, e.g., U.S. Pat. No. 3,117,561, the entire disclosure of which is hereby incorporated by reference into this specification.

An epitrochoidal curve is formed by first selecting a base circle and a generating circle having a diameter greater than that of the base circle. The base circle is placed within the generating circle so that the generating circle is able to roll along the circumference of the base circle. The epitrochoidal curve is defined by the locus of points traced by the tip of the radially extending generating or drawing arm, fixed to the generating circle having its inner end pinned to the generating circle center, as the generating circle is rolled about the circumference of the base circle (which is fixed).

In one embodiment, the epitrochoidal curve is generated in accordance with the procedure illustrated in FIG. 29 of U.S. Pat. No. 5,431,551, the entire disclosure of which is hereby incorporated by reference into this specification.

Figure 4:
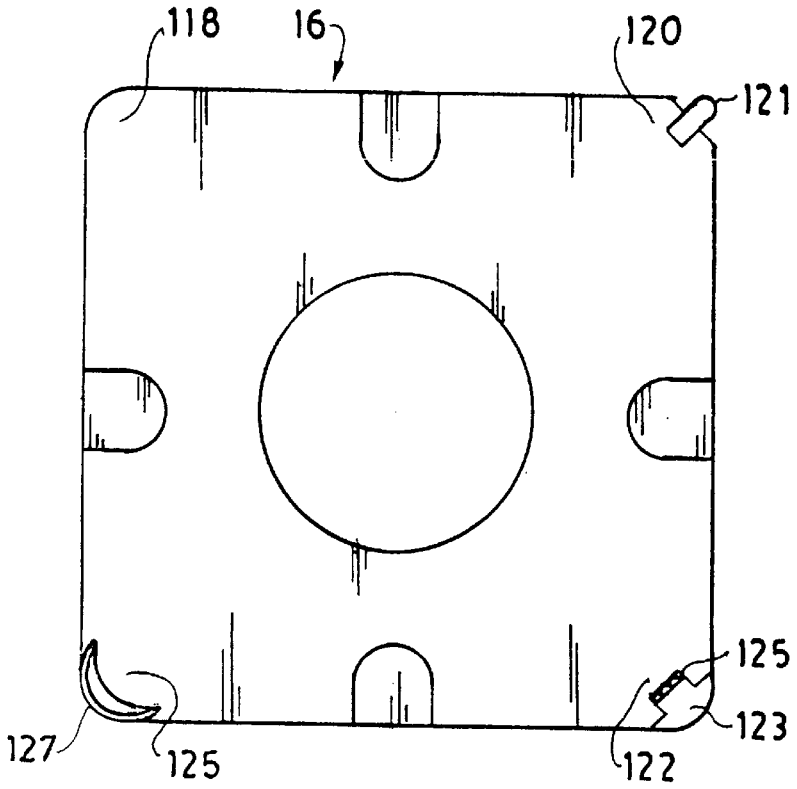
FIGS. 4, 5, 6, 7, and 8 are schematic representations of a rotor with a solid curved surface, a strip seal, a spring-loaded seal, and a and a strip of material, as well as all of these structures, disposed at one or more of its apices sealing purposes.
Figure 5:
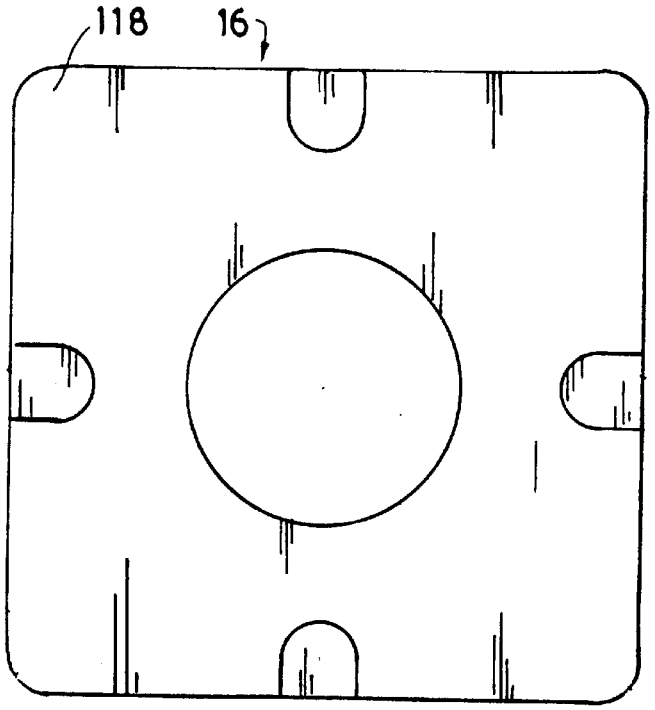

As is disclosed on lines 36 to 55 of column 5 of U.S. Pat. No. 4,395,206, it is common practice to recess or carve out the corresponding profile of the epitrochoid member a distance "x" equal to the outward offset of the apex seal radius (see FIG. 4 of such patent). As is stated on lines 48 et seq. in such patent, in ". . . the case of an inner envelope type device 20', as shown in FIG. 4, such carving out requires that the actual peripheral wall surface profile 33 which defines the cavity 34 of the housing 35 be everywhere radially outwardly recessed from the ideal epitrochoid profile 36. In the case of an outer envelope device 21', as illustrated in FIG. 5, such carving out requires that the actual peripheral face profile of the epitrochoid working member, rotor 38, be everywhere inwardly radially recessed from the ideal epitrochoid profile 39."

Referring again to FIG. 3, it will be seen that applicants' inner housing surface profile 60 is generated from ideal epitrochoid curve 82 and is outwardly recessed from ideal curve 82 by a uniform distance 84. In one preferred embodiment, uniform distance 84 is a function of the eccentricity of the eccentric 22 used in device 10 (see FIG. 1).

Referring again to FIG. 1, it will be seen that rotary mechanism 10 is comprised of a shaft 14 on which the eccentric 22 is mounted. Shaft 14 preferably has a circular cross-section and is cylindrical in shape. Shaft 14 is connected to eccentric 22. In one embodiment, illustrated in FIG. 1, shaft 14 and eccentric 22 are integrally formed and connected.

In one preferred embodiment, both shaft 14 and eccentric 22 consist essentially of steel such as, e.g., carbon steel which contains from about 0.4 to about 0.6 weight percent of carbon.

FIG. 4 of U.S. Pat. No. 5,431,551 is a front view of the shaft/eccentric assembly of this patent, and discussion is presented in such patent of the eccentricity of such assembly. As is known to those skilled in the art, eccentricity is the distance of the geometric center of a revolving body (eccentric 22) from the axis of rotation.

Referring again to FIG. 3, and in the preferred embodiment illustrated therein, it is preferred that the distance 84 be from about 0.5 to about 5.0 times as great as the eccentricity of eccentric 22 (see FIG. 1). In a more preferred embodiment, the distance 84 is from about 1.0 to about 2.0 times as great as the eccentricity. In one embodiment, distance 84 is about 0 times as great as the eccentricity.

Figure 6:
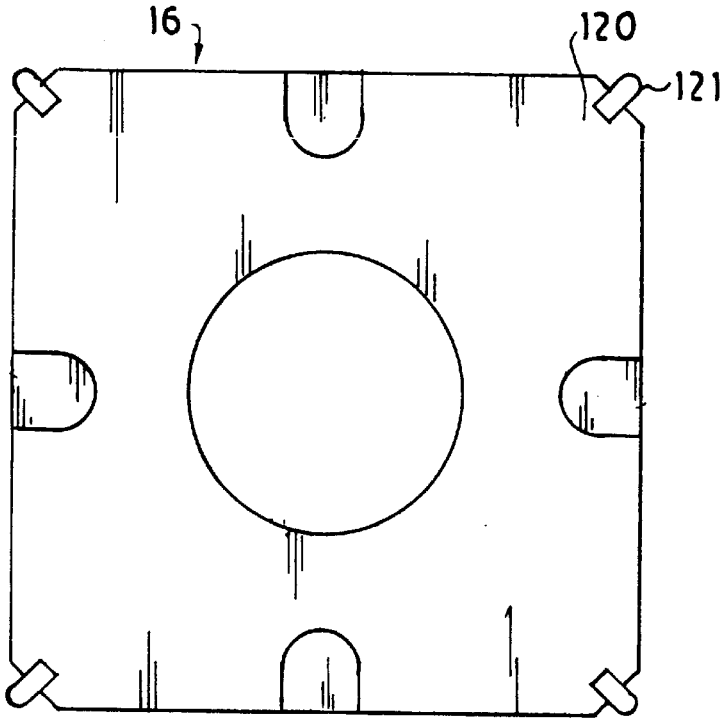

FIG. 6 is a perspective view of a rotor assembly 10 in which the apices 86, 88, 90, and 92 are not directly contiguous with the inner surface 56 of housing 12. In this embodiment, inner surface 56 defines a theoretical trochoidal shape 82 (see FIG. 5).

The apparatus 10 may comprise one or more of apex seals disclosed in FIG. 6 of U.S. Pat. No. 5,769,619, the entire disclosure of which is hereby incorporated by reference into this specification. Thus, FIGS. 4, 5, 6, 7, and 8 depict rotor(s) 16 with different types of scaling surfaces on each of its apices. In these Figures, for the sake of simplicity of representation, the external gear(s) 18 has been omitted.

Referring to FIG. 5, it will be seen that apex 118 is preferably a solid curved surface which is made from the same material as is rotor 16. In this embodiment, the apex 118 is non-compliant, it provides close-clearance sealing at a distance of from about 0.0001 to about 0.002 inches from the inner surface of the housing (not shown), and it will describe an envoluted trochoidal geometry during its operation.

Referring to FIG. 6, apex 120 is connected to an apex seal 121. In the embodiment depicted, apex seal 121 is a linear strip seal which is disposed within rotor 16. Linear strip seal 121 can be metallic or non-metallic.

In one embodiment, where apex seal 121 is a fixed strip of material, it provides close-clearance sealing at a distance of from about 0.001 to about 0.002 inches away from the inner surface of the housing and describes an ideal trochoidal geometry during its operation. In another embodiment, where the seal 121 is made compliant by conventional means, it provides substantially zero clearance sealing and also describes an ideal trochoidal geometry during its operation.

Figure 7:
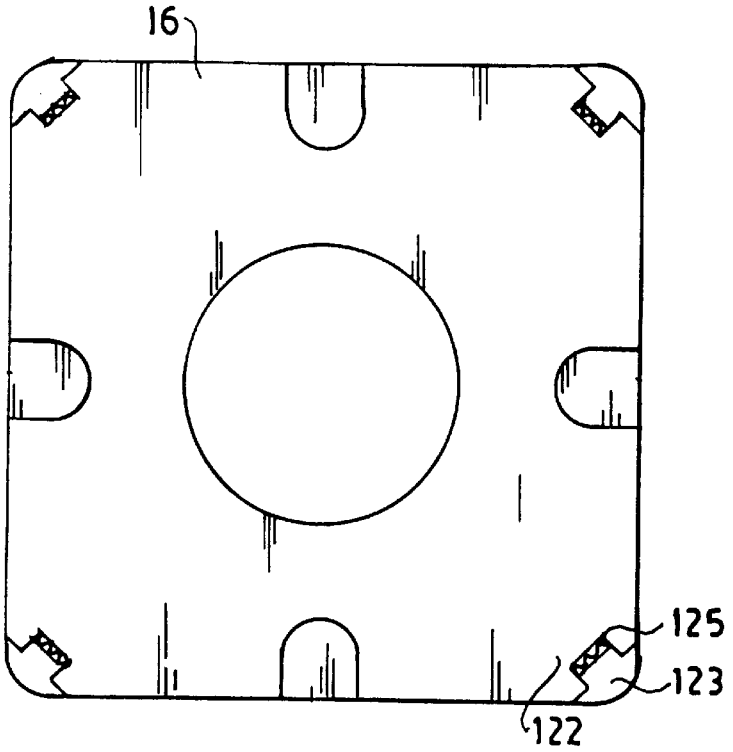

Referring to FIG. 7, apex 122 is comprised of a separate curved surface 123 affixed to apex 122 and made complaint by virtue of the presence of spring 125. In this embodiment, the apex 122 provides substantially 0 clearance sealing and describes an envoluted trochoidal geometry during its operation. The surface 123 may consist of an ultra-high molecular weight plastic.

Figure 8:
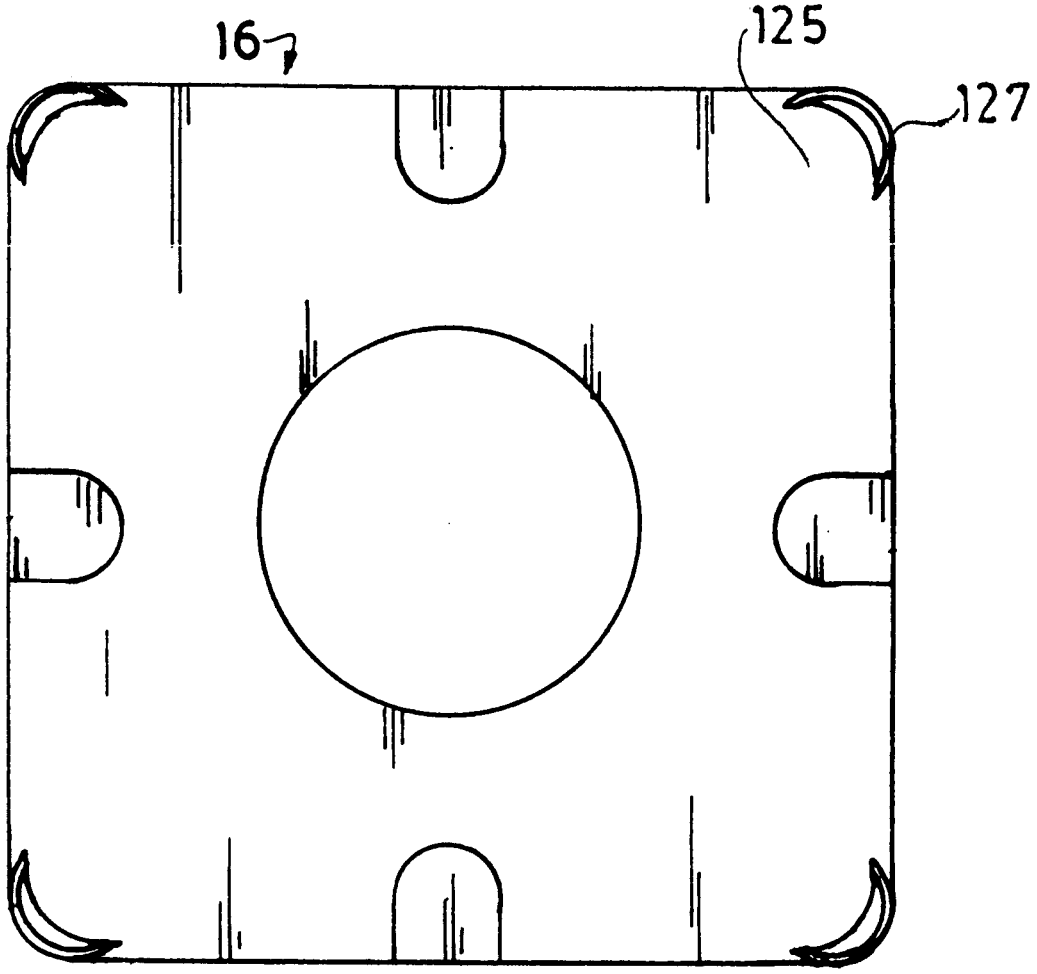

Referring to FIG. 8, apex 124 is comprised of a separate curved surface 127 which is formed from a strip of material pressed into a recess (not shown) in rotor 16. If this curved surface 127 is made from compliant material, apex 124 will also be compliant during operation, thereby providing substantially zero clearance, and will describe an envoluted trochoidal geometry during its operation. A port (not shown) communicating with the pressurized portion of a pressurized volume (not shown) may be employed to pressurize the back the curved surface 127, such that improved clearance control is achieved at higher pressures. In a similar manner, an equalizing pressure can also be applied to linear strip seal 121 (see FIG. 6) and/or surface 123 (see FIG. 7).

FIG. 4 illustrates an embodiment in which each of the different apex sealing means described above exist with reference to one particular rotor 16. It will be apparent that other combinations of sealing means besides the ones depicted also may be used.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A rotary device comprised of a housing with a first side plate, a second side plate, a shaft disposed within said housing, an eccentric connected to said shaft with an eccentricity of from about 0.05 to about 10 inches, a rotor mounted on said shaft, a first gear, and a second gear, wherein:

(a) said rotor has at least about 3 sides, (b) said housing is comprised of an interior surface defined by at least a first lobe and a second lobe, (c) said first gear is an internal gear which is connected to said rotor, wherein said first internal gear has a first pitch diameter, (d) said second gear is an external gear connected to said housing, wherein said second gear has a second pitch diameter, (e) the difference between said first pitch diameter and said second pitch diameter is equal to twice said eccentricity of said eccentric, and (f) the ratio between said first pitch diameter and said second pitch diameter is equal to the ratio between the number of said sides in said rotor divided by the number of said lobes in said interior surface of said housing.

2. The rotary device as recited in claim 1, wherein said housing has a curved inner surface which is in the shape of an envoluted trochoid.

3. The rotary device as recited in claim 2, wherein said rotor is comprised of a first side, a second side, a third side, and a fourth side.

4. The rotary device as recited in claim 3, wherein said housing is comprised of a first lobe, a second lobe, and a third lobe.

5. The rotary device as recited in claim 4, wherein said eccentricity of said eccentric is from about 0.15 to about 1.5 inches.

6. The rotary device as recited in claim 5, wherein said eccentric is disposed within a bearing.

7. The rotary device as recited in claim 6, wherein said rotor is connected to a third gear which is an internal gear.

8. The rotary device as recited in claim 7, wherein said housing is a fourth gear which is an external gear.

9. The rotary device as recited in claim 4, wherein each of said first lobe, said second lobe, and said third lobe have substantially the same curvature.

10. The rotary device as recited in claim 1, wherein said housing has a curved inner surface which is in the shape of an ideal trochoid.

11. The rotary device as recited in claim 1, wherein said housing consists essentially of silicon carbide.

12. The rotary device as recited in claim 1, wherein said first lobe has substantially the same curvature as said second lobe.

* * * * *